United States Patent [19]

Ujihara

[11] Patent Number: 4,637,166

[45] Date of Patent: Jan. 20, 1987

[54] WIRE COMPENSATOR FOR A WIRE DRIVING WINDOW REGULATOR

[75] Inventor: Hiroshi Ujihara, Yokohama, Japan

[73] Assignee: Ohi Seisakusho Co., Ltd., Yokohama, Japan

[21] Appl. No.: 774,917

[22] Filed: Sep. 11, 1985

[30] Foreign Application Priority Data

Sep. 14, 1984 [JP] Japan ..... 59-138755[U]

[51] Int. Cl.[4] ..... E05F 11/48

[52] U.S. Cl. ..... 49/352; 49/374

[58] Field of Search ..... 49/352, 374, 227

[56] References Cited

U.S. PATENT DOCUMENTS 4,406,089 9/1983 Koch et al. ..... 49/352

4,423,566 1/1984 Hess et al. ..... 49/352

FOREIGN PATENT DOCUMENTS 2836398 2/1980 Fed. Rep. of Germany ..... 49/352

*Primary Examiner*—Kenneth Downey

*Attorney, Agent, or Firm*—Poms, Smith, Lande & Rose

[57] ABSTRACT

A wire compensator which is used in a window regulator for raising and lowering a window glass of a motor car door by driving wires connected to the window glass, said wire compensator can absorb elongation occurred in the wires due to tensions repeatedly applied to the wires by means of a pair of levers being rotatable by a spring, so that the wires can be kept stretched at a predetermined tensile strength.

5 Claims, 9 Drawing Figures

WIRE COMPENSATOR FOR A WIRE DRIVING WINDOW REGULATOR

BACKGROUND OF THE INVENTION

This invention relates to a wire compensator for absorbing elongation of wires in a wire driving window regulator for raising and lowering a window glass of a motor car door or the like by means of wires.

In FIG. 1, there is shown a typical conventional window regulator which comprises a vertical guide rail 2, a carrier plate 63 mounted on this guide rail to be movable upward and downward and also firmly attached to a window glass (not shown), and a gearing device 64.

A wire 66 being wound round a drum 65 of the gearing device 64 and extending therefrom is led by guide rollers 67, 68 each mounted at the top and bottom of the guide rail 62, and is fastened at each end 66*a*, 66*b* of the top and bottom parts of the carrier plate 63 respectively. The wire 66 passes through tubes 69, 71 between the guide rail 62 and the gearing device 64, and the tubes 69, 71 are attached at each one end to the guide rail 62 by a holder 72, and also are connected at each another end to the gearing device 64 by a compression spring 73.

In this conventional window regulator 61 in which the drum 65 can be rotated in either normal and reverse directions to raise and lower the carrier plate 63 and the window glass, there is a possibility that repeatedly applying tensile loads to the wire 66 made of such as a metal wire causes a permanent elongation in the wire, and this elongation of the wire results in unsteady movement of the carrier plate 63 when raised and lowered.

In order to prevent the above problems, the window regulator 61 as illustrated in FIG. 1 is provided with a tension compensator 74 comprising the compression springs 73 at an end of an outer casing of the gearing device 64, and when elongation occurs in the wire 66, the compression springs 73 may expand to absorb the elongation of the wire 66.

There is also disclosed another example of such a conventional tension compensator in Japanese Patent Publication No. 46-3001 (see FIG. 4 in particular), which has the same characteristic features with the tension compensator 74 as described in the above.

FIG. 2 shows another window regulator according to the prior art, in which a wire 77 is wound round a drum 65 of a gearing device 76, passes through tubes 78, 79 and then is led by guide members 81, 82 each mounted at the top and bottom of the guide rail 62, and is finally fastened at ends 77*a*, 77*b* to the top and bottom of the carrier plate 63 respectively.

The tubes 78, 79 are secured at each one end to the guide members 81, 82 respectively, and bolts 83, 84 each connected to another end of the tubes 78, 79 are screwed onto threaded parts 85, 86 provided at the top and bottom of the gearing device 76.

When elongation occurs in the wire 77, by threading the bolts 83, 84 to substantially increase the route length of the tubes 78, 79 for guiding the wire 77, the elongation of the wire can be absorbed.

In the wire tension compensators as described in the above, there are problems such that arrangements of the wires within the outer casings of the gearing devices 64, 76 are so unnatural that it is heavy to operate the window regulators 61, 75, and that it becomes difficult to adjust tension of the wires 66, 77 according to locations for mounting the gearing devices 64, 76.

SUMMARY OF THE INVENTION

The present invention is a wire compensator for a wire driving window regulator in which a carrier plate attached to a window glass is mounted onto a vertical guide rail to be raised and lowered freely, flexible wires are extended from a gearing device to the carrier plate along said guide rail so as to form substantially a closed loop and to be rotated in either normal and reverse directions by the gearing device, and each end portion of said flexible wires are engaged with said carrier plate, said wire compensator being constructed such that said carrier plate is provided with a pair of movable levers separated at a certain distance with each other, said end portions of the wires are secured to proper parts of said levers respectively, and said levers are biased by a spring in a direction for giving tension to the wires, thereby absorbing elongation of wires.

DESCRIPTION OF THE PREFERRED EMBODIMENTS

The present invention will now be described by way of example with reference to the drawings hereunder.

Figure 1:
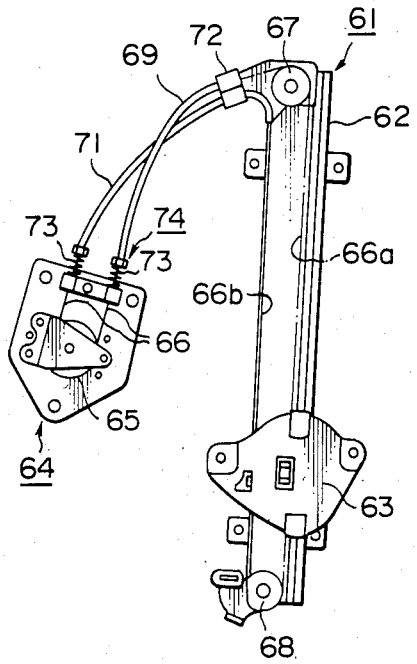
FIG. 1 PRIOR ART
FIGS. 1 and 2 are front elevations of window regulators according to the prior art.
Figure 2:
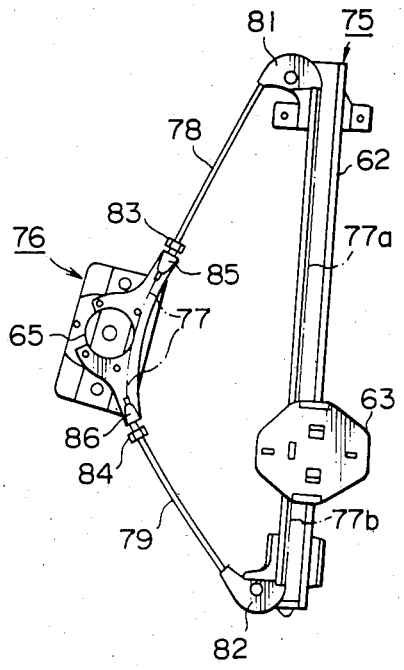
FIG. 2 PRIOR ART
Figure 3:
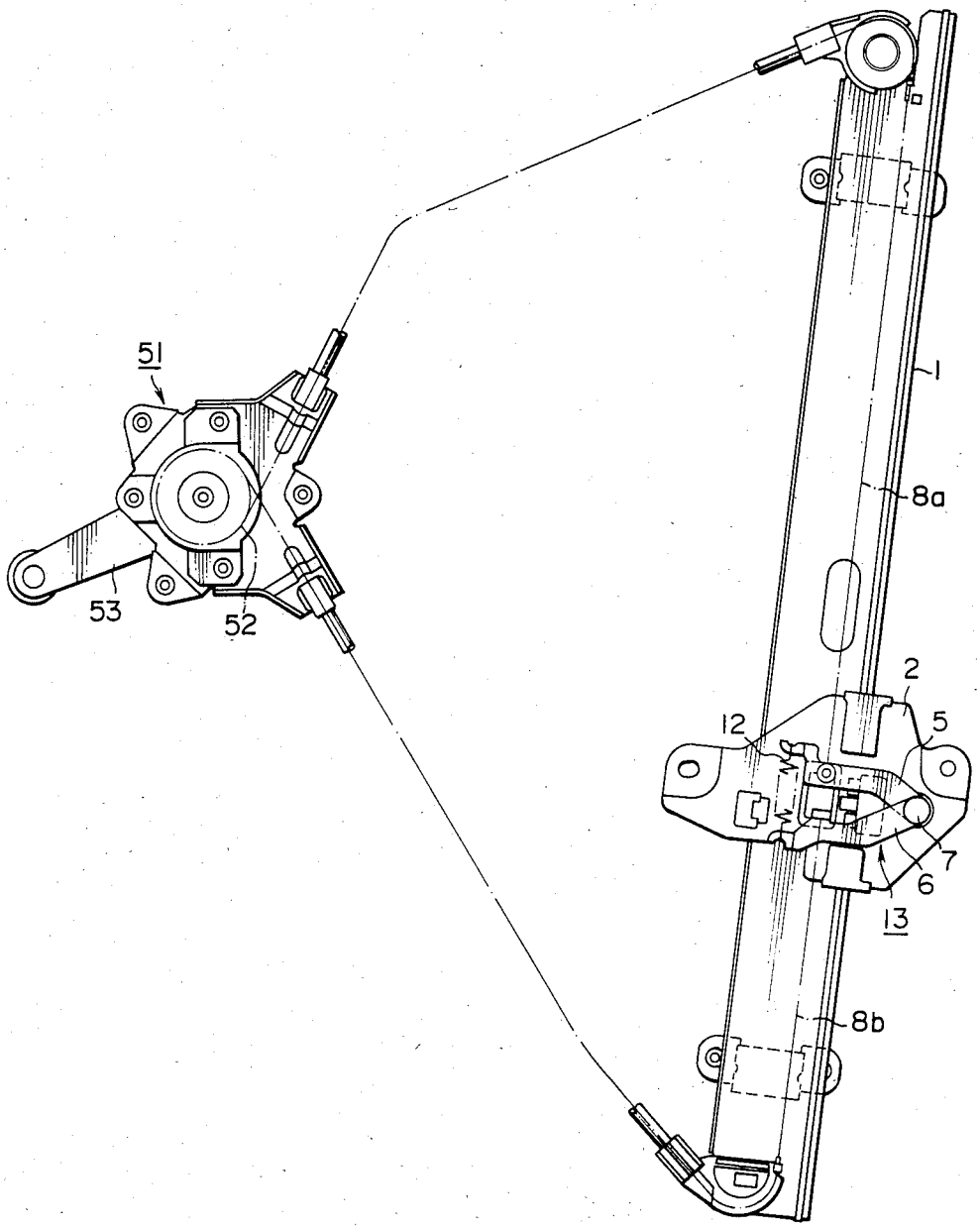
FIG. 3 is a schematic view of a window regulator using a wire compensator according to the present invention.

FIG. 3 shows one embodiment of a wire driving window regulator which is provided with a wire compensator 13 according to the present invention. This window regulator comprises a gearing device 51 including a drum 52 and an operating handle 53 to rotate the drum 52, a carrier plate 2 which is mounted on a guide rail 1 and includes the wire compensator 13, and wires 8*a*, 8*b* which are wound round the drum and extend therefrom to the carrier plate 2 along the guide rail 1.

Figure 4:
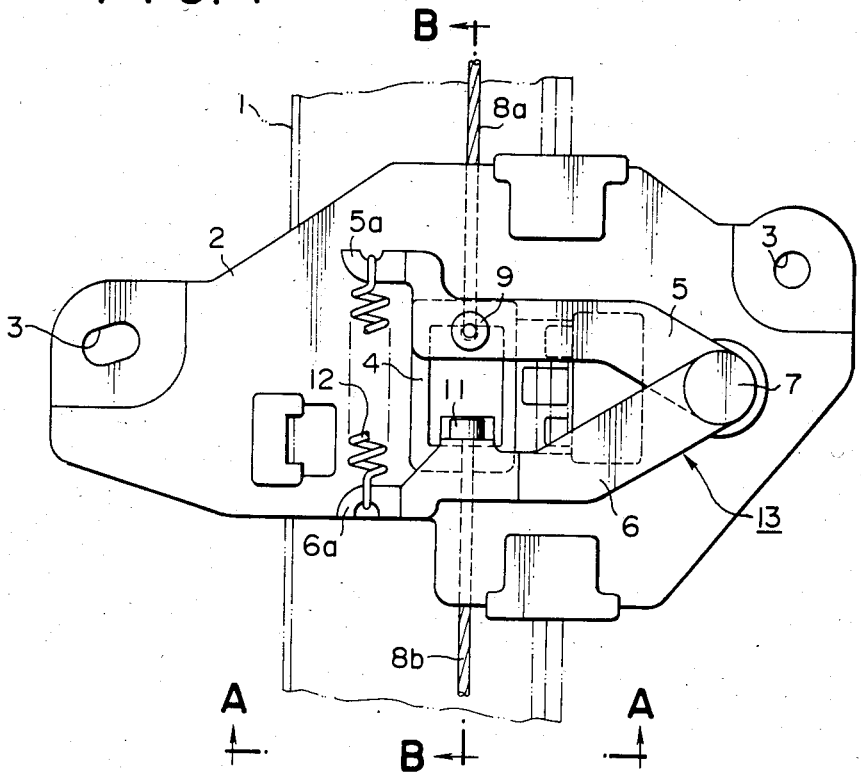
FIG. 4 is a front elevation of one embodiment of a wire compensator according to the present invention.
Figure 5:
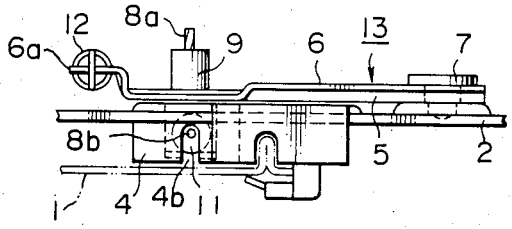
FIG. 5 is a side view in a direction of arrows A—A in FIG. 4.
Figure 6:
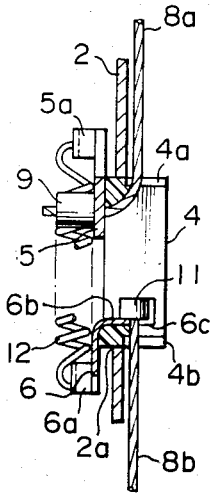
FIG. 6 is a cross-sectional view along line B—B in FIG. 4.

As is well shown in FIGS. 4 to 6, the guide rail 1 is fixedly mounted in a vertical direction to, for example, an inner panel (not shown) of a motor car door, the carrier plate 2 is mounted onto this guide rail 1 to be raised and lowered freely, and a window glass (not shown) is attached to the carrier plate 2 at the positions of mount holes 3.

An oblong frame member 4 made of a rigid synthetic resin is firmly fitted into a hole 2*a* formed in the center of the carrier plate 2. A pair of levers 5, 6 are positioned on the front side of the carrier plate 2 transversely with each free end 5*a*, 6*a* separated at a certain distance with each other, and are pivotally mounted at each base part to the carrier plate 2 by means of a shaft 7.

A portion 6*b* at the upper edge of the lever 6 is bent toward inside the frame 4 with its free end bent upward, and a cutout 6*c* is formed in this bent portion 6*b*.

Wires 8*a*, 8*b* are wound round a drum (not shown) of a gearing device and extend therefrom to the carrier plate 2. The wire 8*a* is led to the back side of the lever 5 through a guide roller (not shown) mounted at the top of the guide rail 1, passes through a cutout 4*a* provided at the upper part of the frame 4, and then penetrates the lever 5 from the back side thereof. End portion of the wire 8*a* is passed through a stopper 9 having a small bore and the wire 8*a* is stretched, and then the stopper 9 is staked so that the wire 8*a* can be secured to the lever 5 in a state of being adjusted at an initial tensile strength.

The other wire 8*b* is led to the back side of the lever 6 by way of the bottom end of the guide rail 1, passes through a cutout 4*b* provided at the lower part of the frame 4 and the bent portion 6*b*, and then is connected to the lever 6 by engaging a wire end member 11 in the shape of a short cylinder attached to an end of the wire 8*b* onto an upper surface of the bent portion 6*b*.

Each end of a compression spring 12 is engaged with each free end 5*a*, 6*a* of the levers 5, 6. This spring 12 biases both levers 5, 6 in a direction to give tension to the wires 8*a*, 8*b*.

It is also possible to use another means for biasing both levers 5, 6 in which a torsion spring (not shown) is provided around the shaft 7 instead of the above mentioned spring 12, and each end of the torsion spring is engaged with an upper edge of the lever 5 and an lower edge of the lever 6 respectively.

Thus, the carrier plate 2 is provided with the wire compensator 13 comprising a pair of levers 5, 6, the spring 12 and the others, so that when elongation occurs in the wires 8*a*, 8*b*, the levers 5, 6 are rotated properly by the force of the spring 12 and elongation of the wires can be absorbed easily thereby.

As shown in FIG. 5, the wire compensator 13 is constructed compact in width using the levers 5, 6, so that allocation of space within the window regulator can be achieved effectively.

Figure 7:
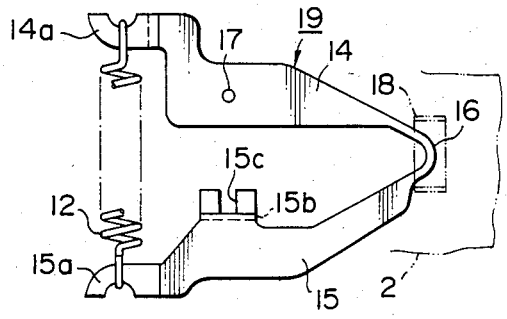
FIG. 7 is a front elevation of another embodiment of the wire compensator according to the present invention.

FIG. 7 shows another embodiment of the present invention.

Both levers 14, 15 are made of a material such as synthetic resins by integral molding, and each free end 14*a*, 15*a* of the levers is engaged with each end of the same spring 12 with the previous embodiment.

A convex or U-shaped connection 16 which continues to each base end of the levers 14, 15 on both sides is made of a thin flexible plate, so that both levers 14, 15 can be properly rotated about the connection 16. In the same manner as the previous embodiment, each end of the wires 8*a*, 8*b* is engaged with a small bore 17 formed in the lever 14 and a cutout 15*c* provided to a portion 15*b* of the lever 15 being bent inward respectively.

On the front side of the carrier plate 2, there is provided a pair of portions 18 being cut and bent perpendicular to the carrier plate 2 to project therefrom to the frontward in parallel with each other. The wires 8*a*, 8*b* are secured to the levers 14, 15 with the connection 16 being inserted between the portions 18, so that a wire compensator 19 comprising the levers 14, 15 and the spring 12 can be held on the carrier plate 2.

Figure 8:
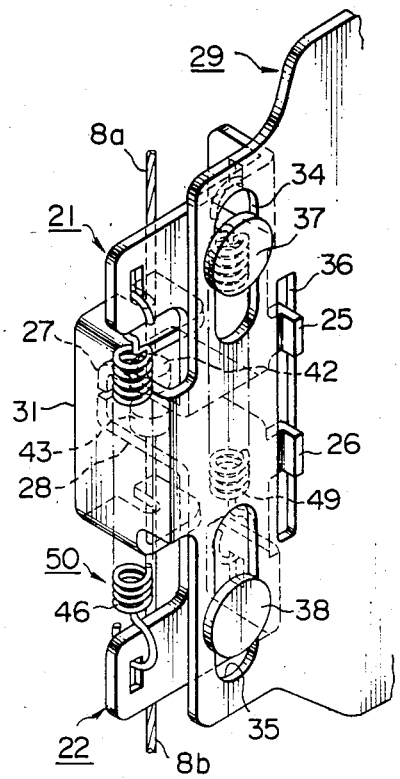
FIG. 8 is a perspective view of still another embodiment of the wire compensator according to the present invention.
Figure 9:
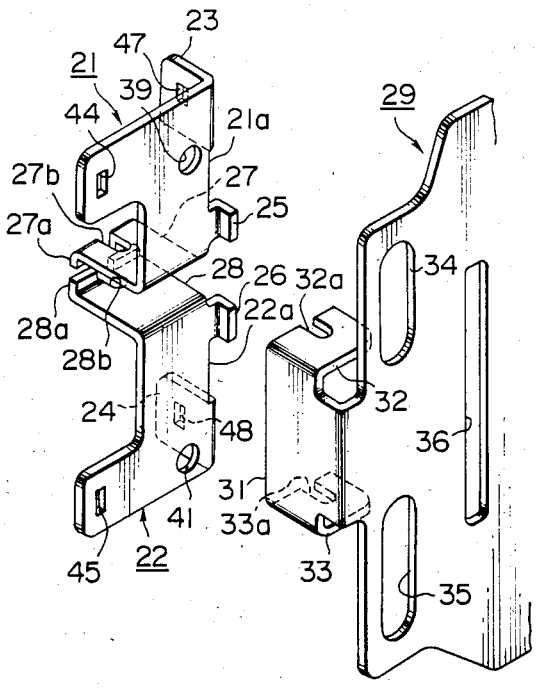
FIG. 9 is an exploded perspective view of the principles of the invention in FIG. 8.

FIGS. 8 and 9 show still another embodiment of the present invention.

Portions 23, 24 on one side edges (on the right side edges in FIG. 9) of the levers 21, 22 located one above the other are formed as being bent backward for engaging a spring thereto, which will be described later. Also, claws 25, 26 are formed forward on the above side edges 21*a*, 22*a*.

The lower edge of the lever 21 is provided with a portion 27 bent backward, which portion 27 has a step 27*a* with a free end bent downward and is provided with a cutout 27*b* having an opening facing backward. On the other hand, the upper edge of the lever 22 is provided with a portion 28 bent backward, which portion 28 has a step 28*a* with a free end bent upward and is provided with a cutout 28*b* having an opening facing backward.

On the upper and lower edge of an arm 31 extending backward and mounted on one side edge (on the right side edge in FIG. 9) of the carrier plate 29, there is provided bent portions 32, 33 with free ends directed to the middle part of the carrier plate 29, and cutouts 32*a* 33*a* are formed in these bent portions 32, 33, each having an opening facing backward. A pair of guide slots 34, 35 located one above the other and a guide slot 36 positioned inside from these slots 34, 35 are formed in the carrier plate 29 on the side of the arm 31.

As shown in FIG. 8, the claws 25, 26 are inserted into the guide slot 36 of the carrier plate 29 and headed shafts 37, 38 passing through the guide slots 34, 35 are firmly secured into holes 39, 41 of the levers 21, 22 respectively, so that both levers 21, 22 are attached to the carrier plate 29 to be raised and lowered freely.

The wire 8*a* passes through the cutout 32*a* of the carrier plate 29 and the cutout 27*b* of the lever 21 and is fastened to the lever 21 by engaging a wire end member 42 connected to the end of the wire 8*a* to the lower surface of the bent portion 27. On the other hand, the wire 8*b* passes through the cutout 33*a* of the carrier plate 29 and the cutout 28*b* of the lever 22 and is fastened to the lever 22 by engaging a wire end member 43 connected to the end of the wire 8*b* with the upper surface of the bent portion 28.

Both ends of a spring 46 are engaged into holes 44, 45 formed in the levers 21, 22 respectively, and both ends of a spring 49 are engaged into holes 47, 48 formed in the bent portions 23, 24 of the levers 21, 22 respectively.

Both levers 21, 22 are biased by the elasticity of the above spring 46, 49 in a direction to give tension to the wires 8*a*, 8*b*. Thus, the wire compensator 50 comprising the levers 21, 22 and the springs 46, 49 can surely absorb elongation of the wires 8*a*, 8*b*.

As described in the above, according to the present invention, a pair of levers are movably attached to a carrier plate which is mounted onto a guide rail to be raised and lowered freely, ends of a pair of wires extending from a gearing device are secured to the levers as mentioned above, and said both levers are biased in a direction to give tension to the wires by the elasticity of a spring being engaged with the levers, so that elongation occurred in the wires can be absorbed; it will not be required to provide a conventional wire compensator of the type to be set in an outer casing of a gearing device; and in comparison to the conventional device, operational loss in the gearing device due to the unnatural arrangements of the wires can be reduced and elongation of the wires can be absorbed without regard to location for mounting the gearing device.

I claim:

1. A wire compensator for a wire driving window regulator in which a carrier plate attached to a window glass is mounted onto a vertical guide rail to be raised and lowered freely, flexible wires are extended from a gearing device to the carrier plate along said guide rail so as to form substantially a closed loop and to be driven in either normal and reverse directions by the gearing device along the closed loop, and each end portion of said flexible wires is engaged with said carrier plate, characterized by that:

a pair of moveable levers comprising two lever members pivotally mounted to the carrier plate and separated at a certain distance with each other, said each end portion of the wires is secured to said levers, and said levers are biased by means of a spring in a direction for giving tension to the wires, so that the lever members may be rotated by the elasticity of the spring and elongation of the wires can be absorbed to keep the wires stretched at a certain tensile strength.

2. A wire compensator as set forth in claim 1, in which said two lever members are mounted to the carrier plate by a pivot shaft so as to rotate about the shaft.

3. A wire compensator as set forth in claim 1, in which said two lever members are united by a flexible connection member secured to the carrier plate so as to rotate about the connection member.

4. A wire compensator for a wire driving window regulator in which a carrier plate attached to a window glass is mounted onto a vertical guide rail to be raised and lowered freely, flexible wires are extended from a grasping device to the carrier plate along said guide rail so as to form substantially a closed loop and to be driven in either normal and reverse directions by the gearing device along the closed loop, and each end portion of said flexible wires is engaged with said carrier plate, characterized in that:

a pair of movable leves separated at a certain distance with each other are mounted to said carrier plate, said each end portion of the wires is secured to a proper part of said levers, and said levers are biased by means of a spring in a direction for giving tension to the wires, and adapted to slide in the direction of the wires by elasticity of said spring, so that elongation of the wires can be absorbed to keep the wires stretched at a certain tensile strength.

5. A wire compensator as set forth in claim 4, in which a pair of guide slots are formed in the carrier plate and said two lever members are attached to the carrier plate by means of a shaft passing through each guide slot so as to slide on the carrier plate along the guide slots.

* * * * *